US008096071B2

(12) United States Patent
Wilson

(10) Patent No.: US 8,096,071 B2
(45) Date of Patent: Jan. 17, 2012

(54) TOPPLE-RESISTANT BASE MECHANISM

(76) Inventor: George H. Wilson, Gilroy, CA (US)

( * ) Notice: Subject to any disclaimer, the term of this patent is extended or adjusted under 35 U.S.C. 154(b) by 151 days.

(21) Appl. No.: 12/396,454

(22) Filed: Mar. 2, 2009

(65) Prior Publication Data

US 2009/0217562 A1 Sep. 3, 2009

(51) Int. Cl.
*G09F 15/00* (2006.01)

(52) U.S. Cl. ..... 40/606.01; 40/606.16; 40/611.01; 40/610

(58) Field of Classification Search ..... 40/606.01, 40/606.16, 611.01, 610; 116/63 P
See application file for complete search history.

(56) References Cited

U.S. PATENT DOCUMENTS

| | | | | |
|---|---|---|---|---|
| 2,324,820 | A * | 7/1943 | Capps | 40/610 |
| 4,279,105 | A * | 7/1981 | Cameron | 52/71 |
| 4,411,085 | A * | 10/1983 | Farmer | 40/610 |
| 5,442,870 | A * | 8/1995 | Kochanowski | 40/582 |
| 5,737,862 | A * | 4/1998 | Cooper et al. | 40/611.03 |
| 5,860,386 | A * | 1/1999 | Schwab et al. | 116/63 P |
| 6,393,748 | B1 * | 5/2002 | Cooper | 40/610 |
| 6,668,474 | B2 * | 12/2003 | Winterton et al. | 40/610 |
| 2003/0046840 | A1 * | 3/2003 | Evans et al. | 40/538 |
| 2005/0091894 | A1 * | 5/2005 | Hamilton et al. | 40/610 |
| 2005/0167553 | A1 * | 8/2005 | Mettler et al. | 248/188 |

* cited by examiner

*Primary Examiner* — Gary Hoge
(74) *Attorney, Agent, or Firm* — West & Associates, A PC; Stuart J. West; Shaun N. Sluman

(57) ABSTRACT

Gust Busters solves the problem of signs being blown over in the wind or being knocked down by the pedestrians or bicycle or the like, by preventing the inward collapsing and outward expansion of the legs of the sign and thus maintaining its ideal position for optimum readability.

10 Claims, 4 Drawing Sheets

TOPPLE-RESISTANT BASE MECHANISM

BACKGROUND

1. Field of the Invention

The present disclosure relates to the field of signage and in particular relates to sign holders that are specifically designed to prevent the signs from toppling over.

2. Background

There is a huge market for outdoor signage advertising, for example the real estate signs which can be portable and interchangeable. Various varieties of portable bases to hold such signage are currently available in the market.

A problem common to most available portable bases is that the bases are generally designed to be lightweight and to occupy a minimum space. As a result, the bases are less stable and thus susceptible to wind and/or being pushed over by pedestrians or bicycles and the like.

Hence, what is needed is a base that holds the signage in a desirable position without being toppled over or moved into a less desirable position and thus provides a stable support for the signage.

DETAILED DESCRIPTION

Figure 1A:
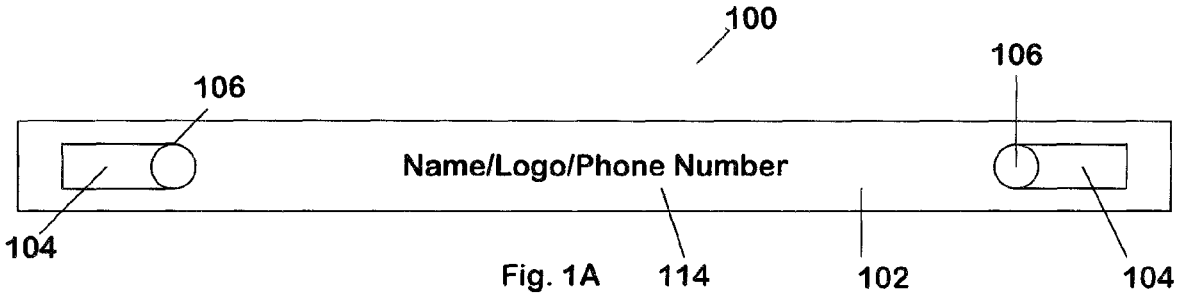
FIGS. 1A-1B depict an embodiment of the apparatus.

In the embodiment depicted in FIG. 1, the apparatus 100 can include a base 102 and at least one receptacle base unit 104 that can be made of plastic. However in alternate embodiments, the apparatus 100 can be made of any other known and/or convenient material and/or composition of materials.

In some embodiments, the apparatus 100 can be manufactured as a single unit utilizing an injection mold. In alternate embodiments, the apparatus 100 can be manufactured as separate pieces that can be later assembled using ultrasonic welding techniques, adhesives and/or any other known and/or convenient permanent and/or semi-permanent bonding technique and/or material. In still further alternate embodiments, the apparatus 100 can be manufactured using any other known and/or convenient technique.

In the embodiment depicted in FIG. 1, the apparatus 100 can be designed to hold Polyvinylchloride (PVC) signs. In some embodiments, the legs of the signs can selectively mate with the openings 106 in the receptacle base units 104. In some embodiments the receptacle base units 104 can include fastening mechanisms 108, such as bolts with wing nuts and or any other known and/or convenient fastening mechanism adapted to selectively secure the leg of sign with the receptacle base unit 104. However in alternate embodiments, the fastening mechanisms 108 may not be present.

In some embodiments the receptacle base units 104 can include slots 110 adapted to receive flat boards, such as sandwich-type signs. Additionally, in some embodiments the receptacle base units 104 can include fastening mechanisms 108, such as bolts with wing nuts and or any other known and/or convenient fastening mechanism adapted to selectively secure a flat board of a sign with the receptacle base unit 104. However in alternate embodiments, the fastening mechanisms 108 may not be present.

In further alternate embodiments, the Gust Buster can be designed to hold any other known and/or convenient signs using any known and/or convenient design.

In some embodiments, the underside of the base 102 can include an anti-skid surface 112 and/or can be comprised of an anti-skid material, intended to increase surface friction with the surface in which it is in contact with, thus preventing movement on a slippery surface. In some embodiments, the coefficients of static and kinetic friction can be selected to control movement under desired design parameters. However in alternate embodiments, the underside of the base 102 can include any other known and/or convenient material and/or exhibit any other known and/or desired properties.

In some embodiments, angled receptable sockets 104 can be configured to maintain an ideal basic angle of an open sign, and allow for ease of insertion of the legs and/or boards of a sign.

In some embodiments, the receptacle sockets 104 can accommodate a variety of tubular leg shapes as well as a variety of flat placard signs.

In some embodiments, the apparatus can be designed and/or manufactured to withstand prescribed inclement weather conditions and/or severe ultra-violet/sun exposure. In some embodiments this can be accomplished by the addition of coatings. However, in alternate embodiments the materials can be selected such that they inherently exhibit desirable properties.

The apparatus 100 can be designed to enhance the existing signs, thus no modification to the sign itself is necessary. Its design also can support additional advertising space.

In some embodiments, the base 102 can include identifying information and/or any other desired marking 114.

Figure 1B:
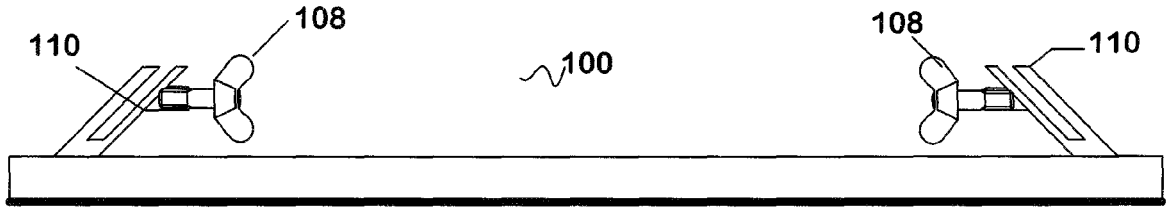
Figure 2A:
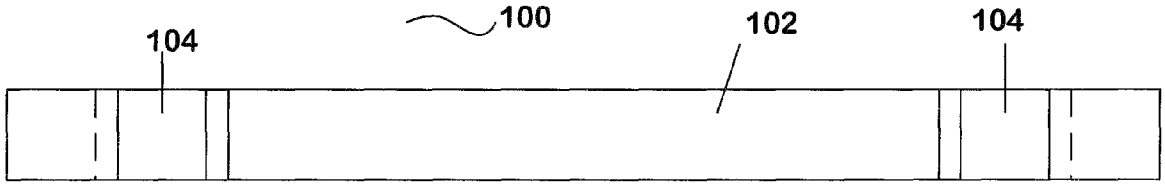
FIGS. 2A-2B depict an alternate embodiment of the apparatus shown in FIG. 1.
Figure 2B:
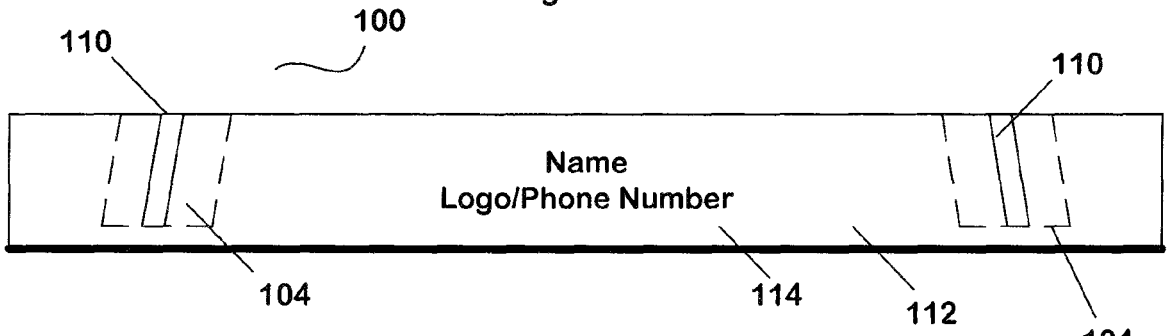

FIGS. 2A-B depict an alternate embodiment of the apparatus 100 depicted in FIGS. 1A-1B. In the embodiment depicted in FIGS. 2A-2B, the base 102 can be sufficiently thick such that the receptacle base units 104 can be incorporated within the body of the base 102. Additionally, in some embodiments, the base unit 102 can include slots 110 to accommodate flat board signs in addition to legs.

As noted with regard to FIGS. 1A-1B, the apparatus 100 can include a non-skid surface 112 located on the underside of the base 102. Additionally, in some embodiments the side and/or top surfaces of the base 102 can include any desired markings 114.

Figure 3:
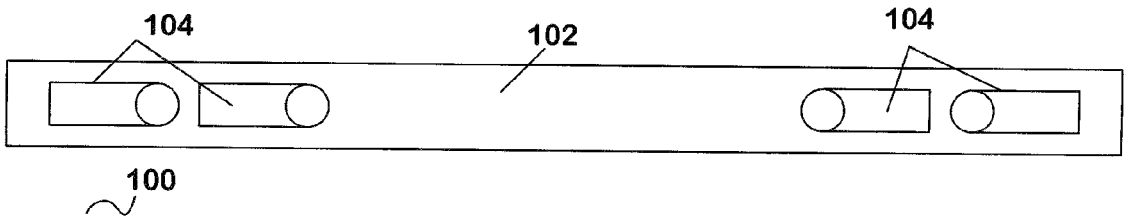
FIG. 3 depicts an alternate embodiment of the apparatus shown in FIGS. 1-2.

FIG. 3 depicts an alternate embodiment of the apparatus 100 depicted in FIGS. 1-2. In the embodiment depicted in FIG. 3, the base 102 can include a plurality of receptacle base units 104, such that signs can be positioned in a plurality of configurations when coupled with the apparatus 100. In some embodiments, the angle of the receptacle base units 104 relative to the base 102 can differ depending upon the distance between the receptacle base units 104 and/or any other known and/or convenient design parameter.

Figure 4A:
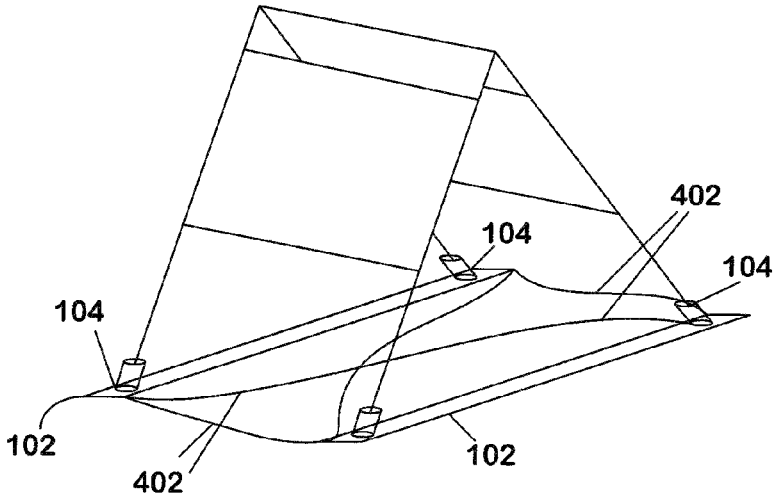
FIGS. 4A-4B depict an alternate embodiment of the apparatus depicted in FIGS. 1-3.
Figure 4B:
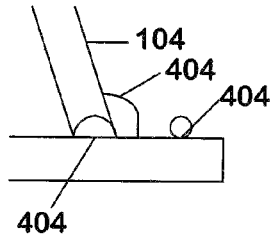

FIGS. 4A-4B depict an alternate embodiment of the apparatus depicted in FIGS. 1-3. In the embodiment depicted in FIG. 4A, the individual bases 104 can be selectively coupled via one or more tethers 402. In some embodiments the tethers 402 can fixedly coupled with the bases 102. However, in alternate embodiments, the tethers 402 can be selectively coupleable with one or more of the bases 102 and one or more locations on each base 102. In some embodiments the tethers 402 can be made of a similar and/or non-reactive material relative to the composition of the bases 102. Moreover, in some embodiments the tethers 402 can include fastening mechanisms at each end capable of selectively and/or fixedly coupling with the bases 102.

In the embodiment depicted in FIG. 4B, the base 102 is depicted as including one or more fastening points 404. In some embodiments, the fastening points can be located near and/or concurrently with the receptacle base units 104. However, in alternate embodiments the fastening points 404 can be located in any known and/or convenient location on the base 102 and/or receptacle base units 104.

Figure 5:
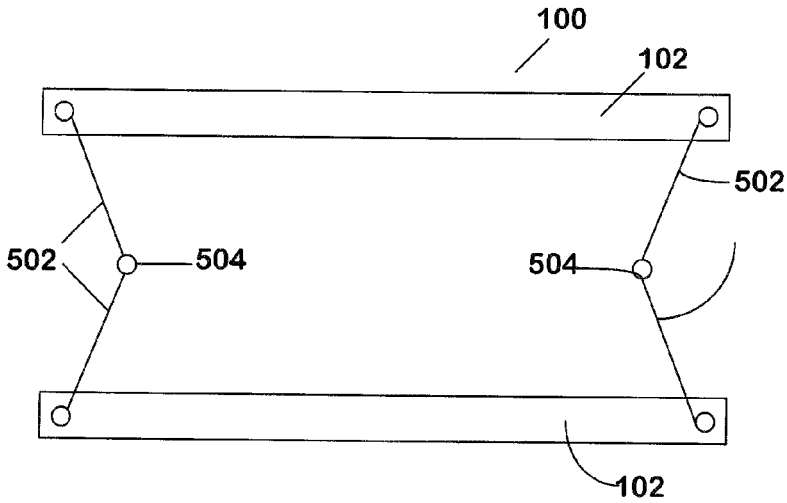
FIG. 5 depicts an alternate embodiment of the apparatus depicted in FIGS. 1-4.

FIG. 5 depicts an alternate embodiment of the apparatus 100 depicted in FIGS. 1-4. In the embodiment depicted in FIG. 5, two bases 102 can be moveably coupled with each other via rigid coupling arms 502. In the embodiment depicted in FIG. 5, the coupling arms can be pivotally coupled between and with the two bases 102. In some embodiments, the hinge 504 pivotally coupling the coupling arms 502 can be configured to selectively lock in at least two desired positions, such that in a first position the bases 102 are a first prescribed orthogonal distance apart and in a second position the bases 102 are a second prescribed orthogonal distance apart. In alternate embodiments, the hinges 504 can be configured to lock in any desired number of position and/or may be configured to be completely free moving.

Figure 6:
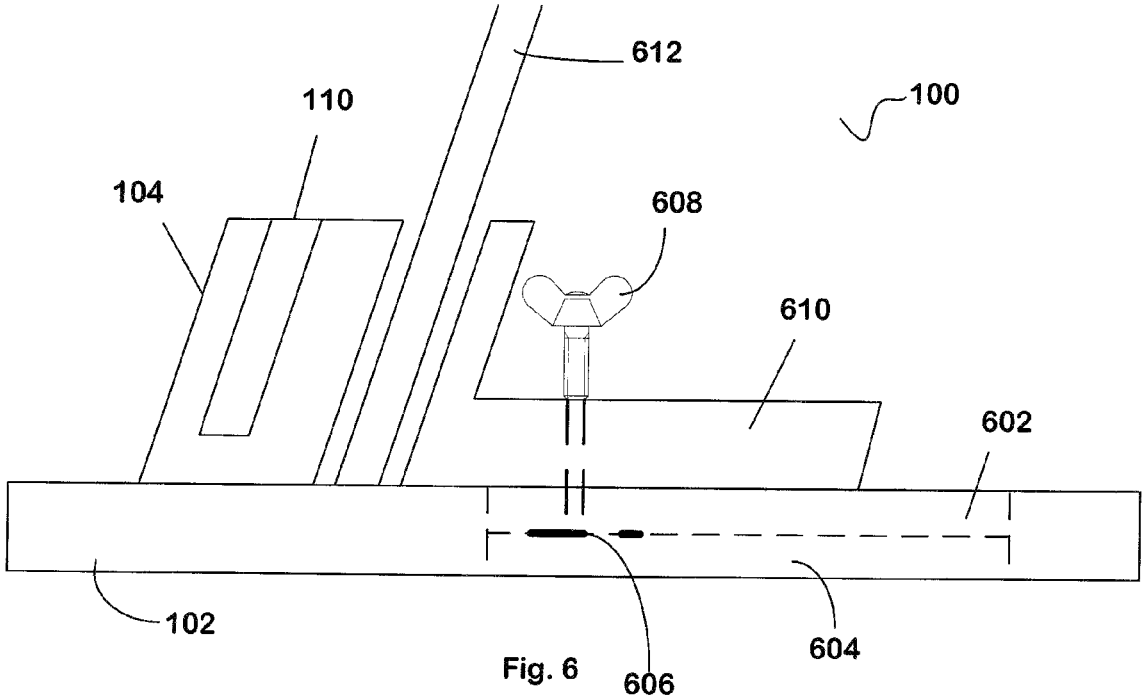
FIG. 6 depicts an alternate embodiment of the attachment mechanism of the apparatus.

FIG. 6 depicts an alternate embodiment of the attachment mechanism of the apparatus 100. In the embodiment depicted in FIG. 6, the base 102 can include a longitudinal slot 602 that passes at least partially through the thickness of the base 102. In some embodiments the base 102 can include a second longitudinal slot 604 located at the underside of the base 102. The slots 602 604 can be adapted to selectively engage a retention mechanism 606 that can be controlled by a manual control 608. The manual control can be operatively associated with and/or coupled with a movable stop 610.

In operation, when the manual control 608 is in a first position, the retention mechanism 606 is in a relaxed state and the movably stop is allowed to freely move relative to the base 102, based upon the geometric limitation of the slots 602 604. When the manual control 608 is in a second position, the retention mechanism 606 engages the base 102 within one of more of the slots 602 604 and restrains movement of the movable stop 610 relative to the base 102. Thus, in operation the moveable stop 610 can be released and/or tensioned such as to selectively engage a sign 612 between the receptacle base unit 104 and the movable stop 610.

In alternate embodiments any other known and/or convenient mechanism can be employed to selectively engage a sign 602 between the receptacle base unit 104 and the movable stop 610.

Figure 7:
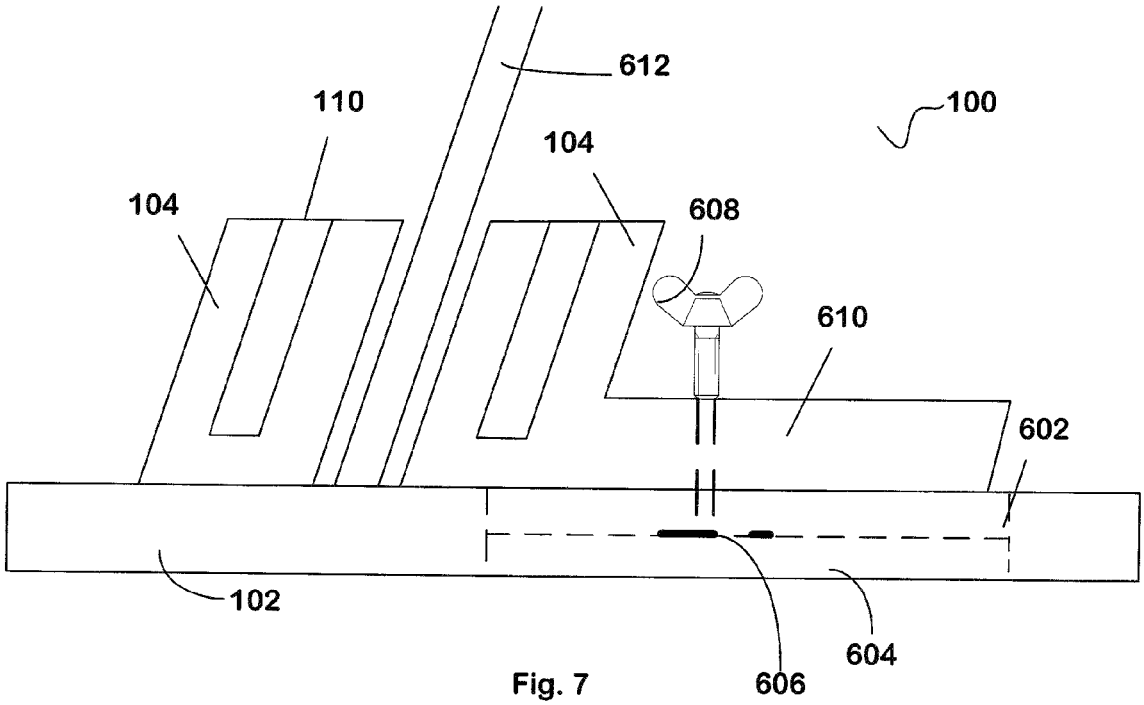
FIG. 7 depicts an alternate embodiment of the attachment mechanism of the apparatus.

FIG. 7 depicts an alternate embodiment of the attachment mechanism of the apparatus 100 depicted in FIG. 6. In the embodiment depicted in FIG. 7, the base 102 can include a longitudinal slot 602 that passes at least partially through the thickness of the base 102. In some embodiments the base 102 can include a second longitudinal slot 604 located at the underside of the base 102. The slots 602 604 can be adapted to selectively engage a retention mechanism 606 that can be controlled by a manual control 608. The manual control can be operatively associated with and/or coupled with a movable stop 610. Additionally, in the embodiment depicted in FIG. 7, the movable stop can include a second receptacle base unit 104 which can further include a slot 110.

In operation, when the manual control 608 is in a first position, the retention mechanism 606 is in a relaxed state and the movably stop is allowed to freely move relative to the base 102, based upon the geometric limitation of the slots 602 604. When the manual control 608 is in a second position, the retention mechanism 606 engages the base 102 within one of more of the slots 602 604 and restrains movement of the movable stop 610 relative to the base 102. Thus, in operation the moveable stop 610 can be released and/or tensioned such as to selectively engage a sign 612 between the receptacle base unit 104 and the movable stop 610. Additionally, the moveable stop 610 can be positioned in any desired location relative to the base 102 and can selectively receive either a substantially flat board within the slot 110 and/or a leg with the second receptacle base unit 104.

In alternate embodiments any other known and/or convenient mechanism can be employed to selectively engage a sign 602 between the receptacle base unit 104 and the movable stop 610.

Figure 8:
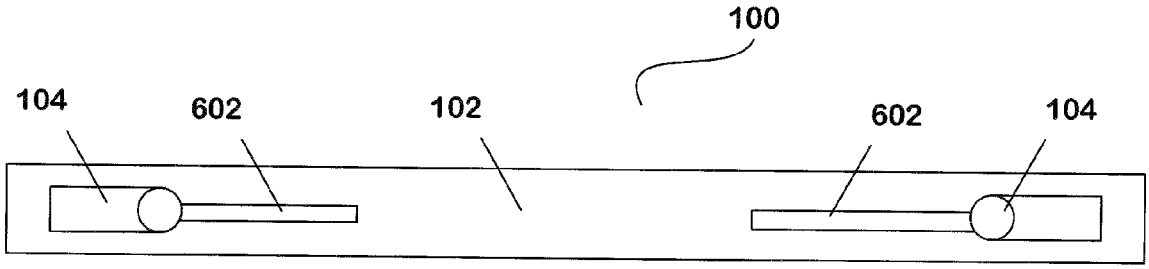
FIG. 8 depicts a top view of the embodiment depicted in FIGS. 6-7.

FIG. 8 depicts a top view of the base 102 depicted in FIG. 7 without the movable stop 610. In some embodiments the slots 602 can each be prescribed lengths. However, in alternate embodiments the slots 602 can be coupled to form a single slot thus allowing placement of the movable stops 610 in any desired location along the length of the base 102.

Figure 9:
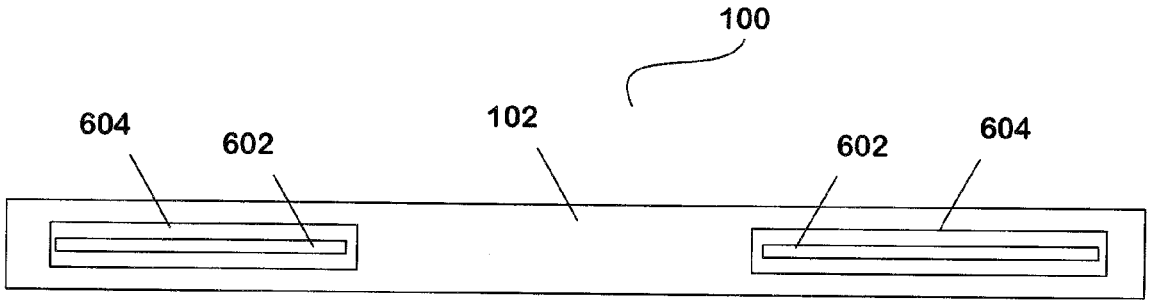
FIG. 9 depicts an underside view of the embodiment depicted in FIGS. 6-8.

FIG. 9 depicts a bottom view of the base 102 depicted in FIGS. 7 and 8. In the embodiment depicted in FIG. 9, the slot 602 can be narrower than slot 604, thus allowing the retention mechanism 606 to pass through slot 604, but not thorough slot 602 and thereby engaging the base 102 when the manual control is in a prescribed position.

Figure 10:
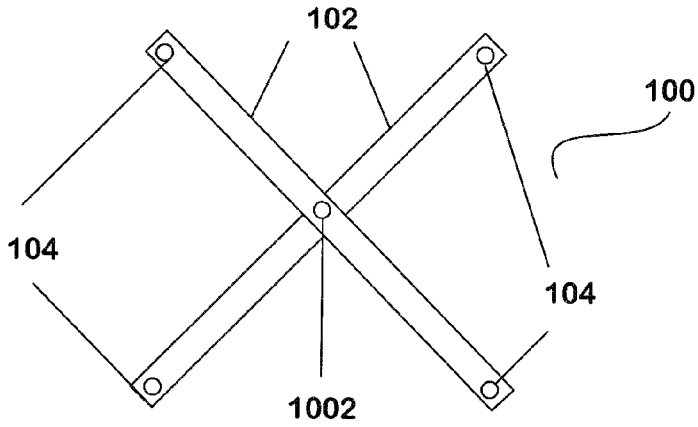
FIG. 10 depicts an alternate embodiment of the apparatus depicted in FIGS. 1-10.

FIG. 10 depicts an alternate embodiment of the apparatus depicted in FIGS. 1-9. In the embodiment depicted in FIG. 10, two bases 102 can be pivotally and/or selectively coupled with each other via a hinge 1002. In operation, the bases can operate in a scissor fashion and be positioned to selectively engage either the legs of a sign and/or the flat boards of a sign, as desired. In some embodiments, the hinge 1002 can permit the bases 102 to be selectively rather than permanently coupled.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A device for holding signage, comprising:

two elongated base members, each having an underside, a top side, and opposing ends;

each base member being coupled with a set of two receptacle base units;

each receptacle base unit in said set being located substantially proximate to opposing ends of one of said base members;

said receptacle base units at least partially extending from the top side of each base member;

said receptacle base units being substantially tubular, wherein said receptacle base units are configured to accept the legs of a sign having at least four elongated legs; and said receptacle base units having a closed end such that the legs of a sign cannot pass through the underside of said elongated base members;

wherein said receptacle base units are angled relative to the horizontal plane of each base member.

2. The device of claim 1, further comprising at least one fastening mechanism coupled with at least one of said receptacle base units, said at least one fastening mechanism being adapted to selectively secure a sign to said at least one receptacle base unit.

3. The device of claim 1, further comprising anti-skid material coupled with at least a portion of the underside of at least one of said base members.

4. The device of claim 1, wherein said base members are comprised of plastic.

5. The device of claim 1, further comprising ultraviolet coating coupled with at least a portion of said base members.

6. The device of claim 1, further comprising:

at least one longitudinal slot passing at least partially through the thickness of each of said base members;

said at least one longitudinal slot being adapted to selectively engage a retention mechanism;

said retention mechanism being adapted to be selectively controlled by a manual control;

said manual control being operatively coupled with a moveable stop device.

7. The device of claim 6, wherein when said manual control is in a first position, said retention mechanism is in a relaxed state and said movable stop device is allowed to move freely relative to one of said base members; and wherein when said manual control is in a second position, said retention mechanism engages said base member via said at least one longitudinal slot, such that movement of said movable stop device relative to said base member is restrained and a sign can be selectively engaged between a receptacle base unit and said moveable stop device.

8. The device of claim 1, wherein said base members are moveably coupled with each other via a plurality of rigid coupling arms.

9. The device of claim 8, wherein at least two of said rigid coupling arms are pivotally coupled with each other between said first and second base members.

10. The device of claim 9, wherein said at least two rigid coupling arms are adapted to selectively lock in at least two configurations via at least one hinge member, such that in a first configuration said base members are a first distance apart, and in a second configuration said base members are a second distance apart.

* * * * *